United States Patent [19]

Swiecicki

[11] 4,095,790

[45] Jun. 20, 1978

[54] TENNIS RACKET WITH TENSIONED ONE-PIECE BALL-STRIKING FRICTION IMPARTING GRID

[76] Inventor: Bronislaw Swiecicki, 3757 N. Oriole Ave., Chicago, Ill. 60634

[21] Appl. No.: 786,040

[22] Filed: Apr. 8, 1977

[51] Int. Cl.[2] ..... A63B 51/02

[52] U.S. Cl. ..... 273/73 D; 273/73 E

[58] Field of Search ..... 273/73 R, 73 C, 73 D, 273/73 E, 73 F, 73 L; 57/139, 140 R, 140 C, 140 J, 141, 144, 149, 153

[56] References Cited

U.S. PATENT DOCUMENTS

| | | | |
|---|---|---|---|
| 763,059 | 6/1904 | Hyde | 273/73 D |
| 1,179,435 | 4/1916 | Hutchinson | 273/73 D |
| 1,364,331 | 1/1921 | Vaile | 273/73 D |
| 3,023,483 | 3/1962 | Steiner | 57/140 J X |
| 3,507,494 | 4/1970 | Finkel | 273/73 D X |
| 3,711,092 | 1/1973 | Hogue | 273/73 D X |
| 3,738,096 | 6/1973 | Crandall | 273/73 D X |
| 3,921,979 | 11/1975 | Dischinger | 273/73 D X |
| 3,926,431 | 12/1975 | DeLorean | 273/73 D |
| 3,966,207 | 6/1976 | Pass | 273/73 D |
| 4,005,863 | 2/1977 | Henry | 273/73 D |
| 4,016,714 | 4/1977 | Crandall et al. | 273/73 D X |
| 4,026,553 | 5/1977 | Vendramini | 273/73 D X |
| 4,034,984 | 7/1977 | Crawford et al. | 273/73 D X |

FOREIGN PATENT DOCUMENTS

| | | | |
|---|---|---|---|
| 1,089,675 | 9/1960 | Germany | 273/73 C |
| 1,043,897 | 11/1958 | Germany | 273/73 D |
| 1,954,912 | 7/1971 | Germany | 273/73 E |
| 454,701 | 4/1968 | Switzerland | 273/73 D |
| 547,946 | 9/1942 | United Kingdom | 273/73 D |

*Primary Examiner*—Richard J. Apley
*Attorney, Agent, or Firm*—Edward R. Lowndes

[57] ABSTRACT

A one-piece, integral, molded, plastic, diaphragm-like grid designed for installation and tensioning bodily within the confines of the usual generally oval or elliptical frame of a tennis racket to supplant the conventional arrangement of interlaced racket strings. A series of small protuberances, disposed on opposite sides of the grid and arranged in checkerboard fashion enhance the frictional characteristics of the grid when the tensioned grid strikes a tennis ball during the playing of a game. An assembled tennis racket embodying such a grid.

5 Claims, 11 Drawing Figures

TENNIS RACKET WITH TENSIONED ONE-PIECE BALL-STRIKING FRICTION IMPARTING GRID

The present invention relates to tennis rackets and has particular reference to a novel racket frame grid which may be formed by an injection or other molding operation from plastic material and which is capable of supplanting the usual crisscross racket string arrangement which is currently used in connection with practically all tennis rackets.

A conventional tennis racket invariably consists of an open wooden or metal frame of generally oval or elliptical design and which is provided with a suitable handle which extends radially outwardly from the long axis of the ellipse. The oval frame is provided with a plurality of spaced bores or holes therein and a plurality of strands, usually Nylon, are passed through such holes and are strung back and forth across the frame and are tensioned to provide a network of interwoven crisscross strands. The ends of the individual strands (of which there may be as many as four or five) are anchored to the frame in various ways, as for example by tying them together, by binding the same in place on the frame, by the use of a suitable epoxy or other adhesive, or by a combination of such means. In any event, the net result is to provide a slightly flexible crisscross pattern or web of Nylon strands which afford a striking surface for the tennis ball.

In actual play, expert tennis players rely heavily upon the frictional characteristics of the crisscross web to exert a slicing effect upon the tennis ball and thus impart a spin to the latter to control the direction and curvature of flight, and also to impart different reflex bounce characteristics. With conventional crisscross webs, such frictional aspects thereof are relatively low since the web, considered as a whole, is in the form of a generally planar diaphragm and this greatly limits the amount of "slice" that can be imparted to any given tennis ball regardless of ball speed and the attendant degree of ball impact against the web. The reason why a professional tennis player calls for a new tennis ball several times during the playing of a tennis match or tournament is to insure better frictional engagement between the racket strings and the ball, a new ball presenting a rougher surface than one which has been in service for an hour or so and therefore offering greater frictional contact with the tennis racket strings.

The present invention is designed to materially increase the coefficient of friction between the tennis ball and racket web with any given tennis ball, regardless of whether the ball is a fresh one or whether it has been service for an appreciable length of time. Accordingly it is the principal object of the invention to provide a tensioned web or grid having a multiplicity of small protuberances on opposite sides thereof, the extent of such protuberances being not so great that it will interfere with the angle of emergence of the ball from the web each time it is struck but which will invariably reflect to a large degree the slicing effect that the player imparts to the ball when a glancing blow is struck.

In carrying out this object the invention contemplates the provision of a unitary, one-piece, integral, flexible plastic, diaphragm-like grid having a multiplicity of such protuberances formed thereon on opposite sides thereof, the contour of the grid being elliptical in conformity with the oval rim of the tennis racket to which the grid is to be applied but being of slightly smaller dimensions so that the grid may be centered within the frame and tensioned thereacross to provide a web which, in appearance, does not differ appreciably from the crisscross interlaced web of a conventional tennis racket.

In addition to the functional advantage of the invention as outlined above, a further advantage resides in the fact that the grid in its entirety may be readily manufactured from a suitable plastic material such as Nylon by an injection or other convenient molding operation, the resultant web being of one-piece construction ready for tensioning in any suitable manner by stretching the same in all directions across the oval frame of a tennis racket. Since the dimensions of practically all standard tennis rackets do not differ appreciably from one another although there may be slight differences between the length and breadth of the racket frame oval, and consequently between the area defined by the oval, the grid is made so that it will fit within practically all oval racket frames with sufficient peripheral clearance that by varying the longitudinal, transverse and diagonal stretching tension imparted to the grid the latter will become functionally effective despite such minor variations in racket design by different manufacturers. Thus the grid may be manufactured in one size which is capable of being fitted to any standard tennis racket frame so that the maintenance of a large inventory of different size grids is not necessary.

In one modified form of the invention, the protuberances are formed on only one side of the grid while, in another modified form, the protuberances are covered with elastomeric caps or coatings to further increase the frictional characteristics thereof. In the preferred form, the protuberances are circular in transverse cross section but in other modified forms various cross sectional shapes may be resorted to.

Numerous other objects and advantages of the invention, not at this time set forth, will become readily apparent as the following description ensues.

In the accompanying two sheets of drawings forming a part of this specification, several illustrative embodiments of the invention have been shown:

Figure 4:
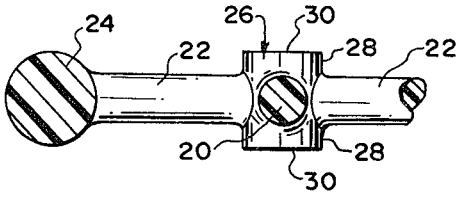
FIG. 4 is a sectional view taken on the line 4—4 of FIG. 3 in the direction of the arrows.
Figure 8:
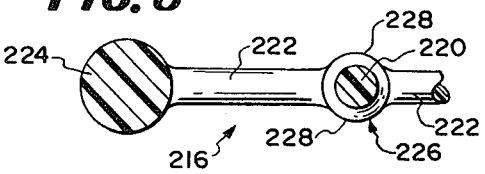
FIG. 8 is a fragmentary sectional view similar to FIG. 4, showing another modified form of grid.
Figure 10:
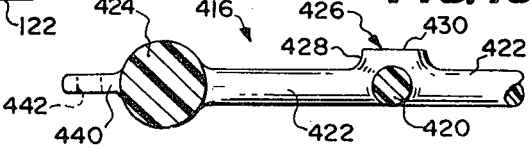
Figure 11:
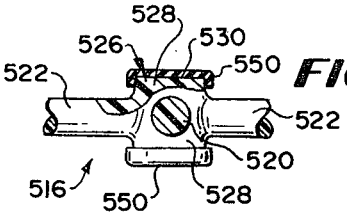

FIG. 10 is a fragmentary sectional view, similar to FIGS. 4 and 8, showing a still further modified form of grid having friction-imparting protuberances on only one side of the grid; and FIG. 11 is a fragmentary sectional view of yet another modified form of grid, the view being taken in the vicinity of one of the strand intersections and showing the adjacent protuberance covered with an elastomeric friction-enhancing substance.

Referring now to the drawings in detail and in particular to FIGS. 1 to 4 inclusive wherein a preferred form of the invention has been illustrated, a tennis racket body of substantially conventional construction is designated in its entirety by the reference numeral 10 and it includes the usual elliptical or oval frame 12 from which there projects a manipulating handle 14, the latter being coincident with the major axis of the ellipse. No claim is made herein to any novelty associated with the racket body 10, the novelty of the present invention residing rather in the construction of a grid 16 which is disposed with, encompassed by and stretched or tensioned across the oval frame 12 and supplants the usual crisscross arrangement of Nylon or other strings ordinarily associated with conventional tennis rackets.

The grid 16 is of unitary, integral, one-piece construction and it is preferably formed by a suitable injection or other molding process from Nylon or other suitable plastic material. The grid 16 is of generally flat sheet-like design having an overall oval configuration commensurate with the elliptical shape of the frame 12 but being slightly smaller longitudinal and transverse dimensions so that when the grid is centered within the confines of the frame a slight clearance 18 is provided coextensively around the grid.

The grid 16 involves in its general organization a series of longitudinally extending aligned strand sections 20 and a series of transversely extending aligned strand sections 22, the various strand sections thus defining a checkerboard arrangement of substantially square openings 23 through the grid. The various strand sections 20 and 22 are encompassed by a continuous oval rim 24.

The region of intersection between each pair of aligned longitudinal and transverse strands 20 and 22 is formed with an enlarged juncture member or mass 26 which, in the form of the invention shown in FIGS. 1 to 4 inclusive, is generally of cylindrical design with its axis extending perpendicular to the general plane of the grid 16. The various members 26 are centered relative to the plane of the grid 16 and the axial extent thereof is such that they afford short protuberances 28 (see particularly FIG. 4) on opposite sides of the grid, these protuberances presenting circular end faces 30. The protuberances 28 serve to enhance the frictional characteristics of grid 16 when a tennis ball is struck thereby as will be described in greater detail presently.

Figure 2:
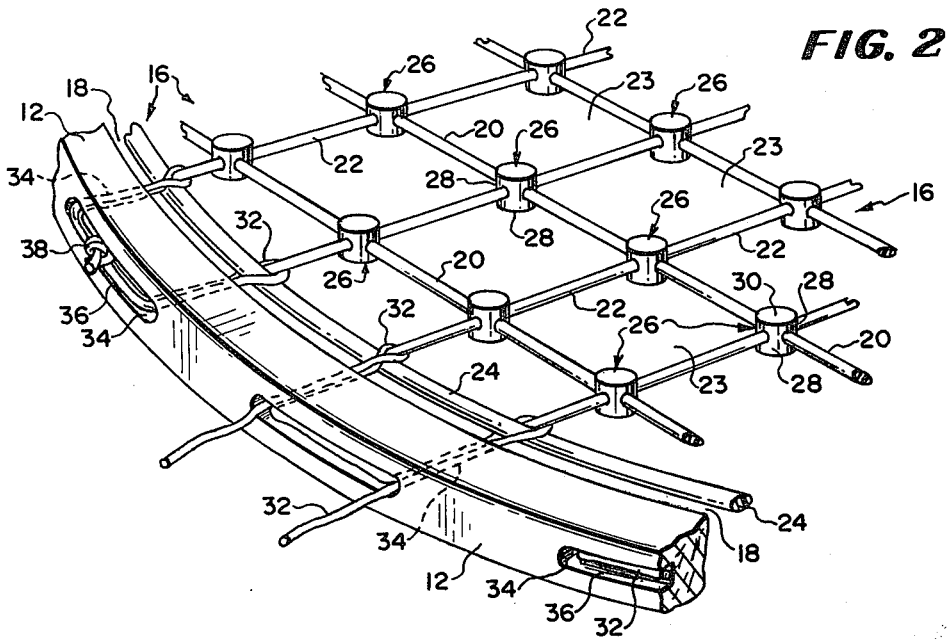
FIG. 2 is an enlarged fragmentary perspective view of a peripheral region of the structure shown in FIG. 1.
Figure 3:
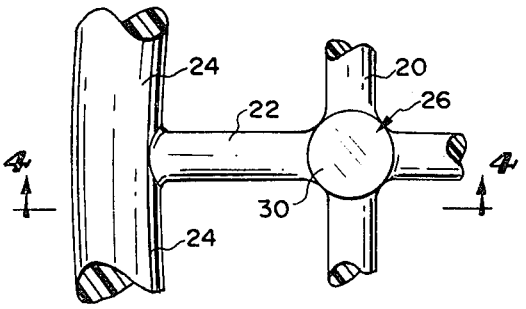
FIG. 3 is a further enlarged fragmentary plan view of a peripheral portion of the grid proper.

Various means may be provided for tensioning the oval grid 16 across the open oval tennis racket frame 12. The tensioning operation may be carried out by utilizing a plurality of short lengths of tensioning strands or strings 32 which preferably are formed of Nylon. As shown in FIG. 2, such lengths are variously passed through the usual generally radially extending bores or holes 34 which are formed in the frame 12 and they are caused to encircle the strand sections 20 or 22 and have their end regions lie in shallow grooves 36 and become tied together as indicated at 38. The specific manner in which the lengths of tensioning strings 32 are anchored to the frame and the manner in which they are tensioned so as to draw the oval rim 24 radially outwardly toward the oval frame 12 constitutes no part of the present invention and various tensioning and anchoring procedures may be employed in accordance with well-known racket string tensioning practice, utilizing conventional tensioning apparatus.

From the above description it will be apparent that when the tennis racket 10 is in use, the checkerboard arrangement of quadrilaterally disposed protuberances on opposite sides of the grid 16 will greatly enhance the frictional characteristics of the grid against a tennis ball when the latter is struck by the tensioned grid. The effective extent of the individual protuberances 28 (FIGS. 2 and 4) which are occasioned by the juncture regions or masses 26 may be varied within small limits but optimum tennis playing conditions have been found to obtain when the extent of such protuberances is on the order of one thirty-second of an inch.

Figure 5:
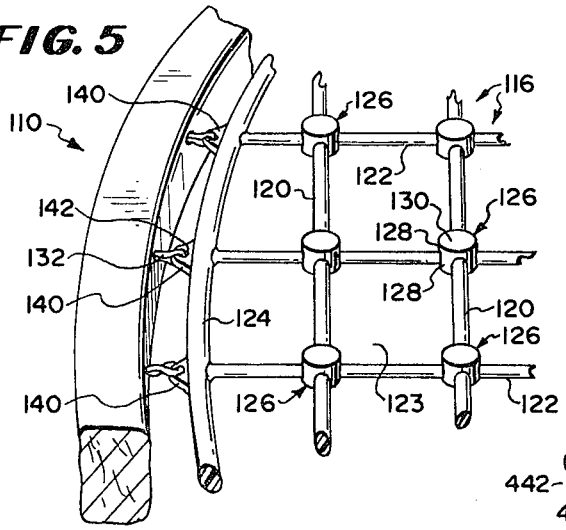
FIG. 5 is a fragmentary perspective view, similar to FIG. 2, showing a slightly modified form of grid.
Figure 6:
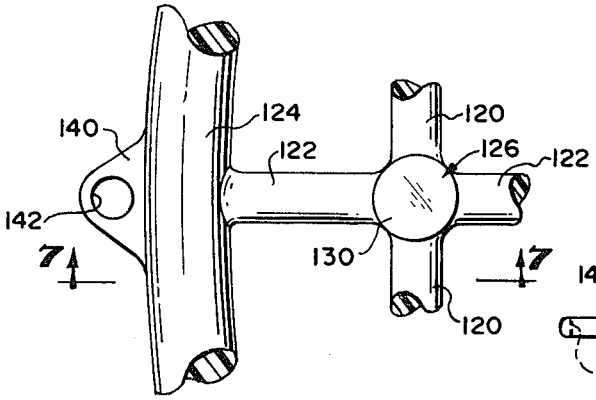
FIG. 6 is a fragmentary plan view, similar to FIG. 3, showing a peripheral region of the modified form of grid.
Figure 7:
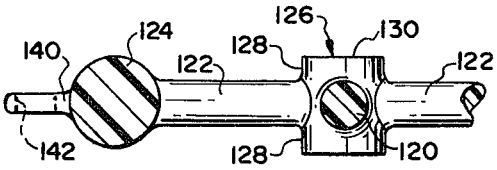
FIG. 7 is a sectional view taken on the line 7—7 of FIG. 6 in the direction of the arrows.

In FIGS. 5, 6 and 7, a slightly modified form of grid 116 has been illustrated. In this formoof the invention the criss-cross arrangement of strand sections 120 and 122 and their associated juncture regions or masses 16 remain precisely the same as in the previously described form of grid 16, the only difference residing in the provision of a plurality of circumferentially spaced string-receiving tabs or ears 140 having eyelet holes 142 formed therein. It has been found expedient to provide one such ear 140 at each end of each row of transverse strand sections 120 and one ear at each end of each row of longitudinal strand sections 122. Otherwise the tennis racket 110 remains substantially the same as the previously described tennis racket 10. In view of the similarity between the tennis racket structures 10 and 110, and in order to avoid needless repetition of description, similar reference numerals but of a higher order have been applied to the corresponding parts as between the disclosure of FIGS. 1 to 4 inclusive, and of FIGS. 5, 6 and 7.

In FIG. 8 a further modified form of grid structure is disclosed. In this form of the invention the grid 216 may employ an oval rim similar to either the rim 24 or 124, the only difference in grid structure residing in the use of a generally spherical juncture member or region 226 at each strand intersection, in place of the cylindrical juncture region 26. The use of such a spherical juncture region affords small semi-spherical hump-like protuberances 228 on opposite sides of the grid. Again, in order to avoid repetition of description a still higher order of similar numerals has been applied to the corresponding parts as between the disclosures of FIGS. 4 and 8.

Figure 9:
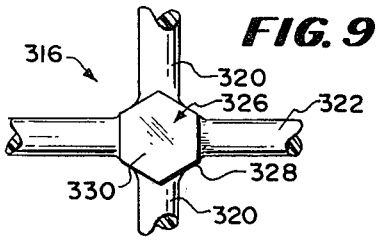
FIG. 9 is a fragmentary plan view of a further modified form of grid, the view being taken in the vicinity of one of the strand intersections.

Utilizing a still higher order of similar numerals, in FIG. 9, the juncture regions 326 of each strand intersection affords polygonal protuberances 328 in place of the cylindrical protuberances 26 shown in FIG. 4.

Again, and utilizing a higher order of numerals in FIG. 10, protuberances 428 similar to the protuberances 28 of FIG. 4 are provided at the juncture regions of the various strands 220 and 422 on only one side of the grid 416, the other side of the grid being substantially planar when the grid is tensioned. In this form of the invention, a player has an option of which side of the grid he shall use to perform a particular stroke.

Figure 1:
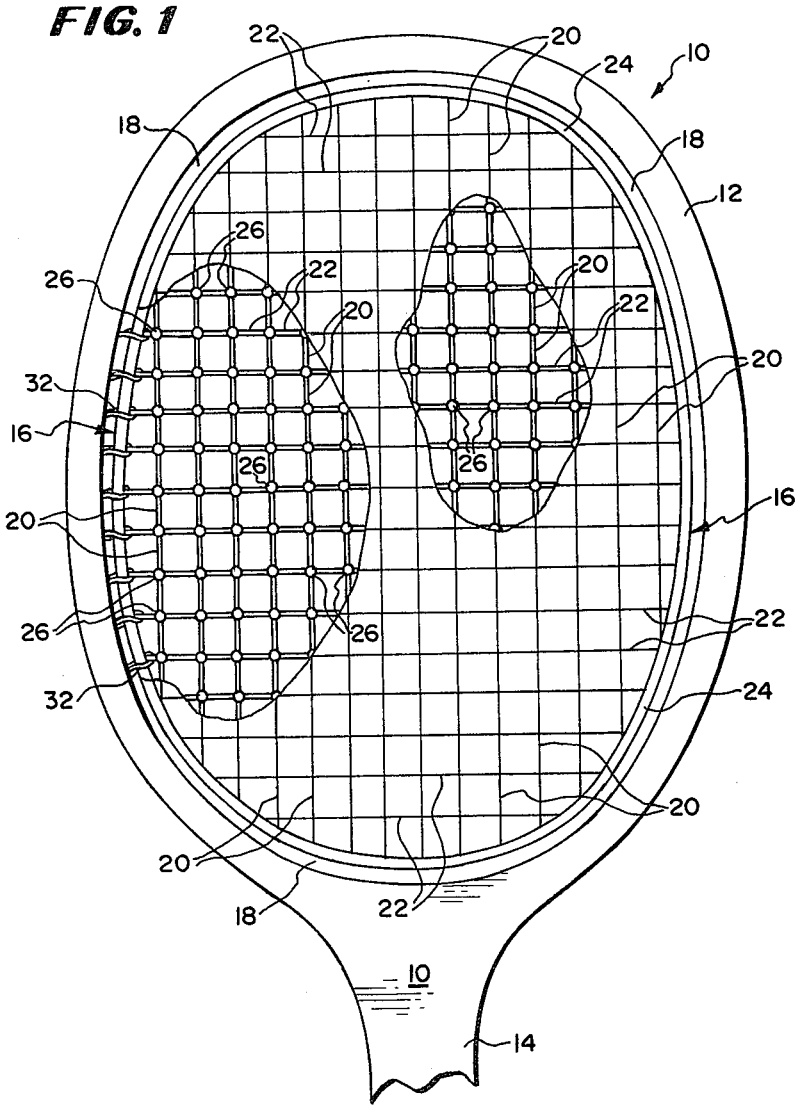
FIG. 1 is a fragmentary plan view of a tennis racket employing the novel grid of the present invention.

In FIG. 11 another modified form of grid 516 is disclosed wherein the juncture regions 526 remain substantially the same as the juncture regions 26 of FIGS. 1 and 4 but wherein, in order to further improve the frictional characteristics of the grid, the protuberances 528 including their circular end faces 530 are covered with a layer or cap of an elastomeric substance such as rubber or the like.

From the above description it is believed that the nature and advantages of the various grids 16, 216, 316, 416 and 516 will be readily apparent without further and detailed discussion.

The invention is not to be limited to the exact arrangement of parts shown in the accompanying drawings or described in this specification as various changes in the details of construction may be resorted to without departing from the spirit of the invention. For example, although the invention has been described in connection with a tennis racket, it is obviously applicable to rackets which are used for paddle ball and other games requiring a flexible tensioned web within the racket frame. Therefore, only insofar as the invention has particularly been pointed out in the accompanying claims is the same to be limited.

Having thus described my invention, what I claim and desire to secure by letters patent is:

1. In a tennis racket having a generally elliptical rigid open frame from which there projects outwardly a manipulating handle, a flexible ball-striking grid centered within and encompassed by said frame, said grid being of one-piece integral molded plastic construction and including a generally elliptical peripheral rim portion the major and minor axes of which are slightly less in extent than the extent of the major and minor axes of the frame, a criss-cross pattern of strands extending coextensively across said peripheral rim portion in checkerboard fashion and including a series of longitudinally extending transversely spaced parallel strands and a series of transversely extending longitudinally spaced parallel strands, all of said strands lying in the medial plane of the elliptical frame, said strands defining a series of generally square openings through the grid, said longitudinally extending strands intersecting said transversely extending strands in the general plane of the grid at quadrilaterally disposed regions throughout the grid, a pair of relatively small outstanding juncture masses integrally formed on said grid at each strand intersection, each juncture mass defining a pair of oppositely extending protuberances which project out of the general plane of the grid on opposite sides thereof and serve to enhance the frictional characteristics of the grid during game-playing operations when a tennis ball strikes either side of the grid, and means extending between the rim portion of the grid and the elliptical frame at spaced regions therearound for tensioning the grid across the frame.

2. A tennis racket as set forth in claim 1, wherein each protuberance is formed with a planar outer face having a sharply defined peripheral rim.

3. A tennis racket as set forth in claim 1, wherein the rim of said grid is formed with a series of radially extending external circumferentially spaced eyelet-forming attachment ears therearound, the elliptical frame is provided with circumferentially spaced openings therein, and said tensioning means includes a plurality of interlacing strings which pass through said eyelet-forming ears and openings.

4. A tennis racket as set forth in claim 3, wherein the outer end face of each protuberance is covered with a layer of an elastomeric substance which enhances the frictional characteristics of such protuberance when the latter strikes a tennis ball.

5. A tennis racket as set forth in claim 2, wherein each juncture mass is generally polygonal in transverse cross section.

* * * * *